United States Patent [19]

Lloyd

[11] Patent Number: 4,693,864

[45] Date of Patent: Sep. 15, 1987

[54] POWDER METALLURGY PROCESS FOR PRODUCING STEEL ARTICLES

[75] Inventor: Donald W. Lloyd, Dunedin Beach, Fla.

[73] Assignee: Donald W. Lloyd Realty, Inc., Clearwater, Fla.

[21] Appl. No.: 804,874

[22] Filed: Dec. 5, 1985

Related U.S. Application Data

[63] Continuation-in-part of Ser. No. 748,167, Jun. 24, 1985, abandoned, which is a continuation of Ser. No. 578,533, Feb. 9, 1984, abandoned.

[51] Int. Cl.[4] ..... B22F 1/00

[52] U.S. Cl. ..... 419/23; 419/28; 419/29; 419/33; 419/36; 419/37; 419/39; 419/46; 419/54

[58] Field of Search ..... 419/23, 28, 33, 29, 419/36, 46, 37, 53, 39, 54

[56] References Cited

U.S. PATENT DOCUMENTS 4,089,681 5/1978 Gueussier ..... 419/28

4,306,901 12/1981 Szekely et al. ..... 419/31

*Primary Examiner*—Stephen J. Lechert, Jr.

*Attorney, Agent, or Firm*—Roylance, Abrams, Berdo & Goodman

[57] ABSTRACT

Mill scale, iron ore, or taconite is utilized in a powder metallurgy process to form steel articles having approximately the same density as that of conventional rolled steel. Particulate iron is mixed with manganese, carbon, additional alloying ingredients, and a binder to form a particulate admixture. The particulate admixture is then compressed, preferably under extreme pressure until the density of the compressed particulate admixture is from about 0.2408 lbs/in$^3$ (6.67 g/cm$^3$) to about 0.2833 lbs/in$^3$ (7.83 g/cm$^3$), which corresponds to a density of from about 85% to about 100% of the density of conventional rolled steel. The resultant coherent mass is subjected to sintering and below fusion heating to form an alloyed article which can be swaged, rolled, drawn, or worked at elevated temperature to decrease the grain size of the alloyed article. The resultant end-product will preferably have a density of from about 0.2408 lbs/in$^3$ (6.67 g/cm$^3$) to about 0.2833 lbs/in$^3$ (7.83 g/cm$^3$), more preferably from about 0.2550 lbs/in$^3$ (7.05 g/cm$^3$) to about 0.2833 lbs/in$^3$ (7.83 g/cm$^3$), and most preferably about the same density as rolled steel produced by conventional means, i.e., about 0.2833 lbs/in$^3$ (7.83 g/cm$^3$). By using additional alloying ingredients, alloys having any desired composition and property may be produced.

17 Claims, 8 Drawing Figures

POWDER METALLURGY PROCESS FOR PRODUCING STEEL ARTICLES

CROSS-REFERENCE TO RELATED APPLICATIONS

This application is a continuation-in-part of application U.S. Ser. No. 748,167, now abandoned filed June 24, 1985 which, in turn, is a continuation of U.S. Ser. No. 578,533, filed Feb. 9, 1984, now abandoned.

BACKGROUND OF THE INVENTION

This invention relates to a powder metallurgy process for forming steel articles. More particularly, this invention relates to a method for producing steel rods and wire using mill scale, iron ore, or taconite as the metallic iron source.

Large amounts of particulate waste in the form of scale is produced at steel-making facilities. The scale is a coating of oxide formed at high temperatures during rolling or forging operations. Thus, steel ingots, billets and other semifinished forms are reheated in furnaces and converted into shapes such as sheets, bars and structural forms in continuous rolling mills, which force hot oxidized particles, known as scale, from the billets or other shapes during the operation. Mill scale is largely particulate iron oxide. Previously, such material has been discarded, notwithstanding the large amounts of iron available for recycle. More recently, processes have been devised for placing the mill scale in a form which will permit recycle of the mill scale in the form of briquettes containing iron adapted for use as feedstock to steel-making furnaces. Such processes are described for example in U.S. Pat. No. 4,369,062 and U.S. Pat. No. 3,870,507.

Powder metallurgy processes have been used to produce steel articles for more than 45 years. For example, U.S. Pat. No. 2,152,006 to Welch discloses a process which compacts and shapes, in a mold, mixtures of metallic powders and binders under a pressure of the order of 2,000 pounds to the square inch and upward. The shaped and coherent body is then removed from the mold, packed in finely divided alundum or equivalent refractory material, within a suitable tube or boat of carbon or other refractory; and so packed, is placed into a sintering furnace. After sintering at 1500°–2000° F., the compacted mixture is shaped by forging, rolling, die-pressing or the like. The shaped article is then heated to a higher temperature just below the melting point of iron whereupon the component metal powders combine to form the intended alloy while retaining their shape. Upon cooling, a usefully shaped metal article is produced. Unfortunately, however, metal articles produced by the Welch process lack the density (and therefore the strength) of articles produced from conventional rolled steel formed from poured steel ingots.

SUMMARY OF THE INVENTION

In accordance with the present invention, mill scale or iron ore in finely divided form is reduced and used to form a particulate admixture along with manganese and carbon. Thereafter, it is admixed with a binder so as to bond the particulate admixture together. The bonded admixture is then formed into a coherent mass by compressing the bonded admixture. The coherent mass is then sintered in a non-oxidizing atmosphere to provide structural integrity and indefinite shelf life. The sintered mass is then heated in a non-oxidizing atmosphere to a temperature just below the fusion temperature of iron to produce a homogenous steel alloyed article. The article is then worked, at elevated temperature, to increase its density and decrease its grain size.

Preferably, the density of the coherent mass after compression is at least about 85% of the density of a rolled steel bar produced by conventional methods. Thus, voids and other internal defects which might be detrimental to quality are controlled and the compressed bonded admixture will be subject to a maximum additional shrinkage rate of only about 15% upon further treatment.

Surprisingly, it has been discovered that steel articles can be produced using the above-described powder metallurgy technique from mill scale, a material formerly recycled in blast furnaces, from iron ore or from taconite, in combination with manganese and carbon. The mill scale contains iron of sufficient purity to enable it to be used in this manner to produce a steel product. Thus, mill scale does not have contaminants such as silicon, phosphorus, sulfur, calcium, silicon or the like which would prevent its utilization in the present powder metallurgy process. Likewise, iron ore and taconite can be processed to the same degree of purity and substituted for mill scale in the process of this invention.

DESCRIPTION OF THE PREFERRED EMBODIMENTS

Figure 1:
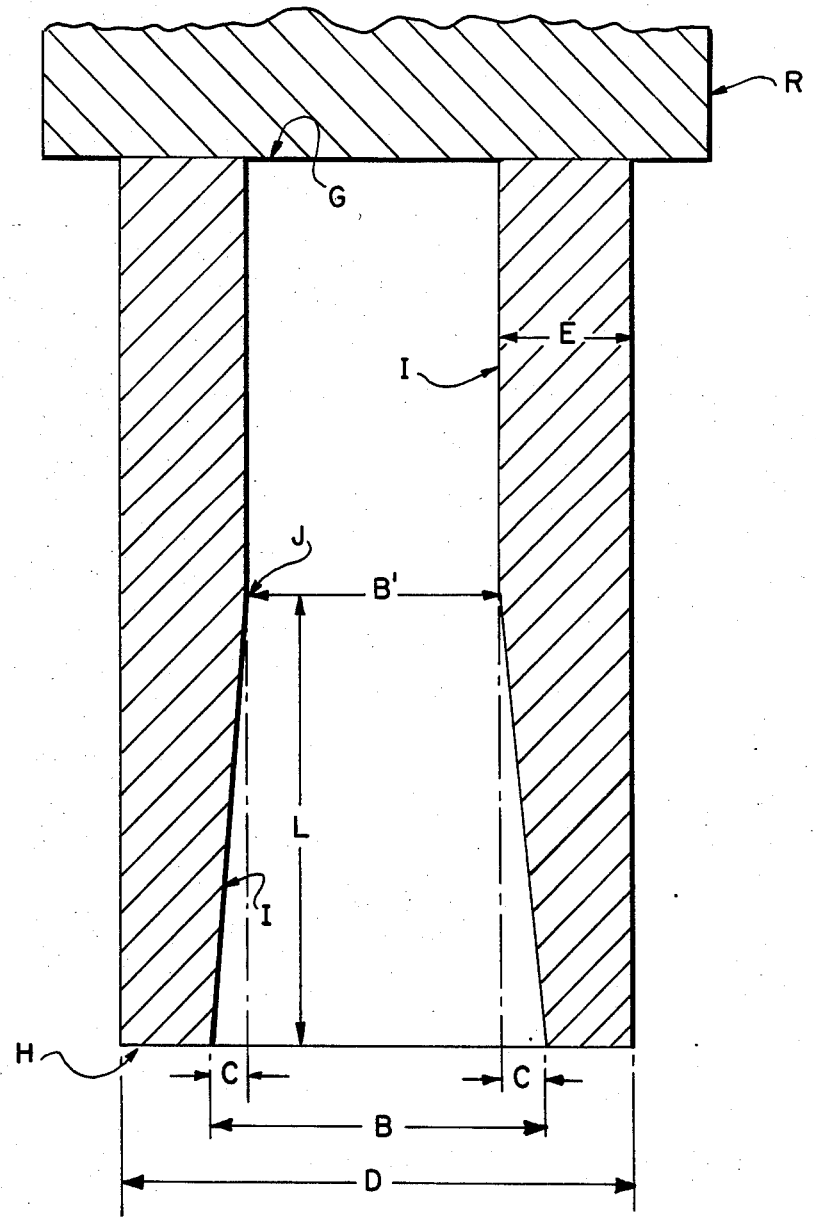
FIG. 1 is a side view in cross-section of a mold which can be used in accordance with this invention to compress an admixture of particulates and binder.

In accordance with the present invention, mill scale, as received from a steel mill is first freed of tramp steel particles and non-metallics by screening. Next, the mill scale is ground to the desired finely divided particulate size so as to permit its successful incorporation into the particulate admixture hereinafter described. The mill scale should be ground as required to provide an average particle diameter of below about 50 microns, preferably between about 35 and about 45 microns, with about 40 microns being especially preferred. Any suitable means for grinding the mill scale can be utilized including ball-miling, rod-milling or hammer-milling.

The mill scale may be determined to be at the desired particle diameter by examining it on a comparator, by passage through a suitable mesh screen or by comparing particles under a microscope.

Alternatively, either iron ore or taconite, both of which contain $Fe_2O_3$, silica and other contaminants such as CaO, sulphur and phosphorus can be used by grinding the ore or taconite to the same size as above-described for mill scale, for example, 40 microns. Next, lime is added to obtain the proper ratio of lime to silica, namely, a ratio of 2 on a molecular basis as determined by the formula $$(CaO—3P_2O_5)/SiO_2$$

The mixture is fired, for example, in a rotary lime kiln at a temperature of about 500° F. (260° C.). This produces a magnetic ore ($Fe_3O_4$) known as "magnetite", which can be crushed and the $Fe_3O_4$ is magnetically separated from the non-metallics using a conventional magnetic separator. The resulting $Fe_3O_4$ can be substituted for mill scale.

Next, mill scale or magnetite having the desired average particle diameter is passed to a reducing zone, which may be a reducing furnace where the mill scale or magnetite is subjected to a temperature in the range of between about 1000° (537° C.) and about 1500° F. (815° C.), preferably between about 1150° (621° C.) and about 1250° F. (676° C.), with a temperature of about 1200° F. (649° C.) being especially preferred. This results in reduced mill scale or magnetite free of oxygen and in the form of substantially pure elemental iron.

The reduction furnace may be any suitable design. Such furnaces are known to the art. For example, U.S. Pat. No. 3,941,359 to Shinville et al discloses a reduction furnace for reduction of mill scale, the disclosure of which is hereby incorporated by reference.

The substantially pure metallic iron, is blended with manganese and carbon in a mixing zone in dry form, for example, in a ball mill. Both the manganese and the carbon are in a reduced state to avoid the presence of oxides. The manganese may be used in any suitable particle size. For example, manganese having an average particle diameter of below about 50 microns, preferably between about 35 and about 45 microns, with about 40 microns (about −235 mesh) being especially preferred. Preferably, the elemental iron and the manganese have the same particle size. Likewise, the carbon, which may be carbide or similar carbonaceous material may be employed having an average particle diameter of below about 50 microns, preferably between about 35 and about 45 microns, with about 40 microns being especially preferred. The carbon should be of the same particle size as the iron and manganese.

A suitable particulate admixture comprises about 98 weight percent metallic iron; from about 0.035 to about 2.00 weight percent manganese; and from about 0.04 to about 2.00 weight percent carbon, all in reduced form. For example, a suitable mixture can include those used in A.I.S.I. Nos. C 1008 to C 1021 comprising iron with the remainder being carbon and manganese as follows:

| A.I.S.I. No. | C | Mn |
|---|---|---|
| C 1008 | 0.10 max. | 0.25/Q.50 |
| C 1010 | 0.08/0.13 | 0.30/0.60 |
| C 1012 | 0.10/0.15 | 0.30/0.60 |
| C 1015 | 0.13/0.18 | 0.30/0.60 |
| C 1016 | 0.13/0.18 | 0.60/0.90 |
| C 1017 | 0.15/0.20 | 0.30/0.60 |
| C 1018 | 0.15/0.20 | 0.60/0.90 |
| C 1019 | 0.15/0.20 | 0.70/1.00 |
| C 1020 | 0.18/0.23 | 0.30/0.60 |
| C 1021 | 0.18/0.23 | 0.60/0.90 |

Preferably, the particulate admixture comprises metallic iron, manganese and carbon. However, additional alloying ingredients may be included, such as chromium, nickel, molybdenum, vanadium, lead, sulfur, aluminum or the like in a reduced state. If such reduced metals are utilized, they should be used in amounts as desired to obtain the strength, ductility, machinability and the like required in the particular article being produced.

The finely divided particles of iron, manganese, carbon, and any additional alloying ingredients are admixed in a mixing tank to achieve a substantially homogenous admixture. Next, a binding agent, preferably of a substantially hydrocarbonaceous nature is added to the admixed particulates in the mixing zone. Any suitable hydrocarbonaceous material can be utilized including clear paraffin, coal tars, pitches, petroleum residue pitches or petroleum reforming bottoms in amount sufficient to bind the iron manganese carbon and/or alloys together. No hydrocarbons which will produce ash when burned should be used. Sufficient binder is added to "wet" the particulate mass, and the appropriate amount can be easily determined experimentally. Preferably, zinc stearate is the binder used, and in an amount of from about 1.0 weight percent to about 4.0 weight percent, and preferably about 2.0 weight percent of the total admixture. Zinc stearate is preferred because it fumes off during the sintering process leaving no residue.

Next, the particulate admixture containing the binder is formed into a coherent mass by compressing the admixture at ambient conditions in a mold to form a bar or other shaped product as desired. Preferably, the admixture is subjected to molding pressures such that the resulting compressed admixture will possess a density of from about 85 to about 100% and more preferably from about 90 to about 100% of the density of conventional rolled steel. Since conventional rolled steel has a density of 0.2833 lbs/in$^3$ (7.83 g/cm$^3$), the resulting compressed admixture will preferably have a density of from about 0.2408 lbs/in$^3$ (6.67 g/cm$^3$) to about 0.2833 lbs/in$^3$ (7.83 g/cm$^3$), and more preferably from about 0.2550 lbs/in$^3$ (7.05 g/cm$^3$) to about 0.2833 lbs/in$^3$ (7.83 g/cm$^3$). Achieving such a density prior to sintering is an important step over the prior art for a number of reasons. First, the resulting green strength of the greatly compressed admixture provides the bar with the ability to be handled without fear of fracturing. Other methods, which use significantly less pressure, produce bars which crumble easily and cannot be handled on a production basis. Second, bars produced under great compression contain fewer undesirable voids and do not readily oxidize as do those of the prior art. This allows bars made in accordance with this invention to be directly inserted into the sintering or alloying furnace. Bars produced under less compression must be protected from oxidation by packing in a suitable boat or tube in a finally divided alundum. Third, and perhaps most important, bars of this invention which have undergone sintering and alloying can be swaged, rolled, drawn or otherwise worked without a great deal of shrinkage, whereas bars having much lower densities can not be further worked without significant shrinkage after sintering and alloying. Thus, the alloyed bars of this invention can be further worked to produce an end-product bar having a density equal to that of conventional rolled steel bars. The end-product bar can then be cold-worked to form the desired fabricated article. Cold-working of other power metallurgy bars, which have not been worked in accordance with this invention, is difficult, if not impossible due to their much lower densities.

It should be understood, however, that the foregoing improvements resulting from imparting a density of at least about 0.2408 lbs/in$^3$ (6.67 g/cm$^3$) to the compressed admixture are not the only improvement provided by the process of this invention when compared to prior powder metallurgical processes.

Another aspect of this invention provides improved steel alloy articles made from powder metallurgy techniques, which have properties similar or superior to steel articles made from either conventional methods or other, different powder metallurgy methods. This is because the powder metallurgy process of this invention provides for working the resulting alloyed article at elevated temperature to increase its density and decrease its grain size, thereby increasing its strength and ductility. Preferably, the alloyed article is worked by swaging, rolling, drawing or otherwise until its density is from about 0.2408 lbs/in$^3$ (6.67 g/cm$^3$) to about 0.2833 lbs/in$^3$ (7.83 g/cm$^3$), more preferably from about 0.2550 lbs/in$^3$ (7.05 g/cm$^3$) to about 0.2833 lbs/in$^3$ (7.83 g/cm$^3$), and most preferably a density equal to that of conventional rolled steel, i.e., about 0.2833 lbs/in$^3$ (7.83 g/cm$^3$). Even when the density of the alloyed bar is 0.2833 lbs/in$^3$ (7.83 g/cm$^3$) prior to working at elevated temperature, the working step is still very advantageous because it reduces the grain size, which is enlarged due to heating during the alloying step.

As discussed above, the compressed admixture preferably has a density of at least about 85% of the density of conventional rolled steel. This number is not an empirical value below which the process will fail, but rather a common sense value below which the process becomes increasingly impractical. Simply stated, the greater the density of the compressed admixture, the lesser the shrinkage resulting from working the resulting alloyed article. Obviously, it follows that the lesser the shrinkage, the larger the resulting bar, and since the economics of scale favor larger end-product bars, it follows that greater density is desired in the initial compressed admixture. Furthermore, lower densities would mean that much larger molds would be required, and sintering and alloying furnaces would either have to be larger, or they would process much less steel in terms of the end-product bar. Thus, for numerous practical reasons, bars of greater density are preferred.

Referring now to FIG. 1, a mold is shown which can be used in accordance with the present invention. The wall thickness E must be sufficient to withstand from about 17 to about 40 tons of pressure per square inch (from about 234 to about 552 megapascals). The necessary wall thickness can be determined using the formula:

$$E=PD/(2S)$$

wherein,

P=pressure

D=outside diameter

S=tensile strength of steel used to make the mold.

The inside configuration of the mold can be circular, square, rectangular, etc. One end of the mold G is closed by a removable base R. The other end of the mold H is open. The inside wall I tapers inwardly from the open end H, for a taper length of L, to point J after which the inside dimensions of the mold remains constant. Thus, the inside dimension of the mold will vary, for a taper length of L, from B at the open end H to B′ at point J. The degree of tapes C, which is drawn larger than scale, is on the order of a few thousandths of an inch. The mold is tapered because otherwise it would be nearly impossible to remove the compressed admixture from the mold once it has achieved the desired density.

In practice, the admixture is inserted into the open-end H of the mold. A plunger having a transverse cross-sectional dimension slightly less than B′ is then inserted in the open end and from about 20 to about 40 tons per square inch (from about 276 to about 552 megapascals) and preferably from about 30 to about 40 tons per square inch (from about 414 to about 552 megapascals) of pressure or more is exerted on the admixture by means of the plunger. The compression is repeated by withdrawing the plunger, adding additional admixture, and repeating the compression until a compressed admixture of desired length and density is produced. The removable base R is then removed from closed end G and the compressed admixture is pushed out of the mold through the tapered, open end H.

The degree of tape C and length of taper L needed to facilitate instant release of the molded powder can be determined experimentally based upon the dimensions of the article produced in the mold. It has been found that a mold having a square transverse cross-section which will produce a bar 1″×1″×24″ requires a degree of taper C of about 0.001 inch, and a length of taper L of about 4 inches.

Preferably, the inside surface of the mold is covered by a non-stick surface such as polytetrafluoroethylene, etc. It has been found that "DuPont Teflon Wet and Dry Lubricant", which is a product of E. I. DuPont de Nemours & Co., Inc., provides satisfactory results.

While the pressure which is exerted on the admixture will generally be in the range of from about 20 to about 40 tons per square inch (from about 276 to about 552 megapascals), the particular amount of pressure needed will depend upon the desired density. In practice, the density can be quickly calculated by, for example, weighing an amount of admixture which is to be compacted into a bar of known dimensions. Thus, the pressure needed will be that required to compress the total weight of admixture into a pre-determined size bar.

The resulting coherent mass product is then placed in a sintering furnace under a non-oxidizing atmosphere, preferably a reducing atmosphere of hydrogen, and heated to a temperature less than 2600° F. (1426° C.), preferably from about 1400° (760° C.) to about 1600° F. (871° C. ), more preferably from about 1450° (778° C.) to about 1550° F. (843° C.), with about 1500° F. (815° C.) being especially preferred. The coherent mass must remain in the sintering furnace for a period of time sufficient to raise the temperature uniformly throughout. Any suitable sintering furnace can be utilized for sintering of the shaped article.

At this stage in the process, the sintered mass may be cooled, for example, to ambient temperature, and is now sufficiently hard and has adequate structural integrity to be stored or handled without fracturing. The bar can then be formed into any desired shaped article, such as wrenches, hammers, bolts, nuts, or the like.

If cooled, the resultant sintered mass is reheated in a non-oxidizing atmosphere, preferably hydrogen in a furnace to a temperature below the fusion point of the mass, namely 2600° F. (1426° C.), at which temperature the carbon and manganese go into solution. If the foregoing cooling step is omitted, the sintered mass is heated directly to just below the fusion temperature of the mass. The sintered mass should be heated for a time sufficient to raise the temperature uniformly throughout. Suitable temperatures include from about 2300° (1260° C.) to about 2600° (1426° C.), preferably from about 2350° (1288° C.) to about 2499° F. (1370° C.), with 2400° F. (1315° C.) being especially preferred. At this temperature, a homogenous steel alloyed article having the desired ratio of iron to manganese to carbon results.

The resultant alloyed article, unlike other bars produced from powder, can then be immediatly passed through a set of rolls or through a swaging machine, where it is shaped and reduced in size until it has a round cross-section and the desired density. Alternatively, the alloyed article can be cooled, for example to room or ambient temperature, and later reheated for working, namely, to a temperature that will enable it to be passed through rolls or swaged to a round size, if desired. Suitable reheating temperatures include from about 2100° (1148° C.) to about 2300° (1260° C.), preferably from about 2100° (1148° C.) to about 2150° F. (1176° C.), with approximately 2100° F. (1148° C.) being especially preferred.

Next, the resultant bar may be drawn through a draw bench and reduced to a size suitable for cold-work production of screws, bolts and nuts or to wire sizes suitable to produce nails, wire cloth, springs or other wire products. Alternatively, the resultant bar can be rolled or forged to produce seamless pierced pipe, or flat rolled bars for production butt-welded pipes and/or electric-welded pipe. The apparatus for production of such articles is well known to those skilled in this art.

Referring now to FIGS. 2–7, micrographs of a bar produced in accordance with this invention are shown at various stages in the process.

Figure 2:
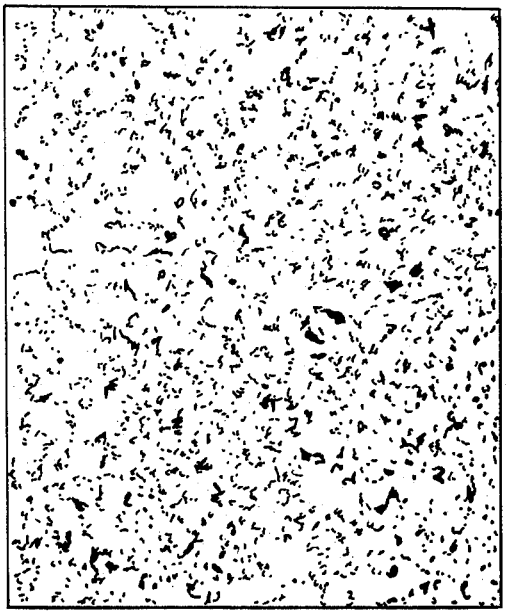
FIGS. 2–7 are micrographs of a steel bar produced in accordance with this invention.

FIG. 2 is a micrograph of a cold-pressed bar, unetched at a magnification of 50×. Many black pores are visible and the cold-pressed bar has a density of about 85–90% when compared to the density of conventional rolled steel.

Figure 3:
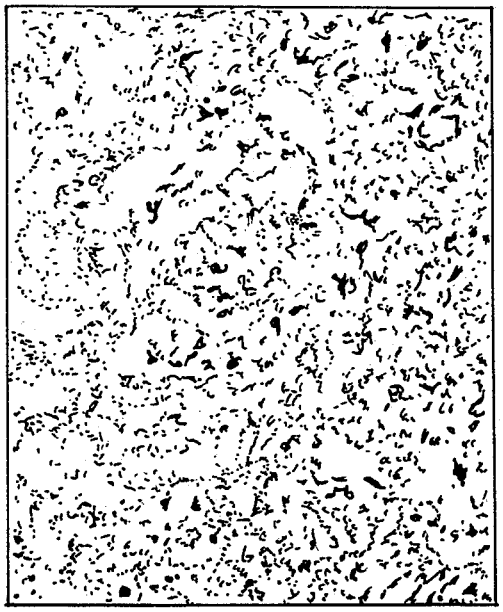

FIG. 3 is a micrograph of the same bar after heating at 2250° F. for one hour, unetched and at a magnification of 50×. Many black pores can still be seen.

Figure 4:
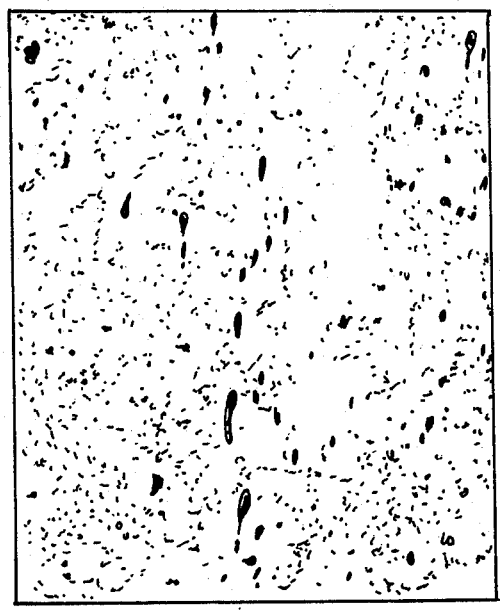

FIG. 4 is a micrograph of the longitudinal surface of the same bar after swaging, unetched at a magnification of 260×. It is seen that most of the pores have been eliminated. The gray phase seen in the micrograph is manganese sulfide.

Figure 5:
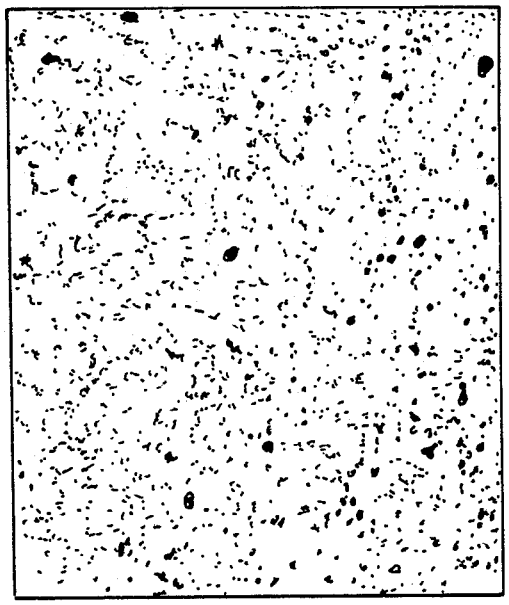

FIG. 5 is a micrograph of the transverse surface of the same bar after swaging, unetched and at a magnification of 260×. Again it can be seen that most of the pores have been eliminated.

Figure 6:
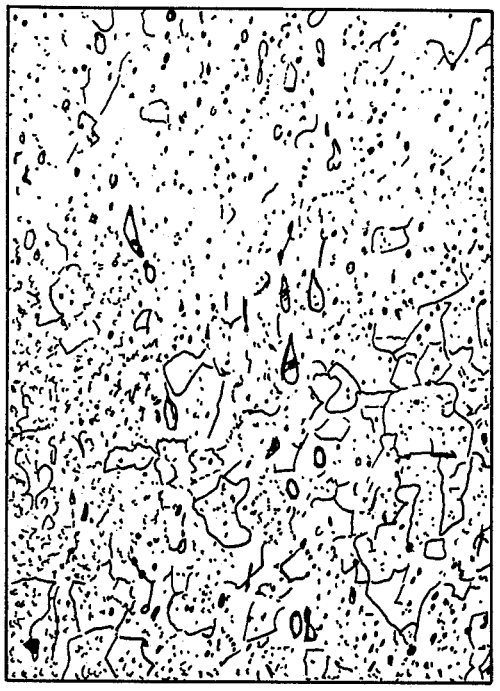

FIG. 6 is a micrograph of the the longitudinal surface of the same bar after swaging, etched and at a magnification of 260×. Grain boundaries are now visible, and the bar is seen to have ASTM No. 10 grain size, which is commonly found in conventional rolled steel.

Figure 7:
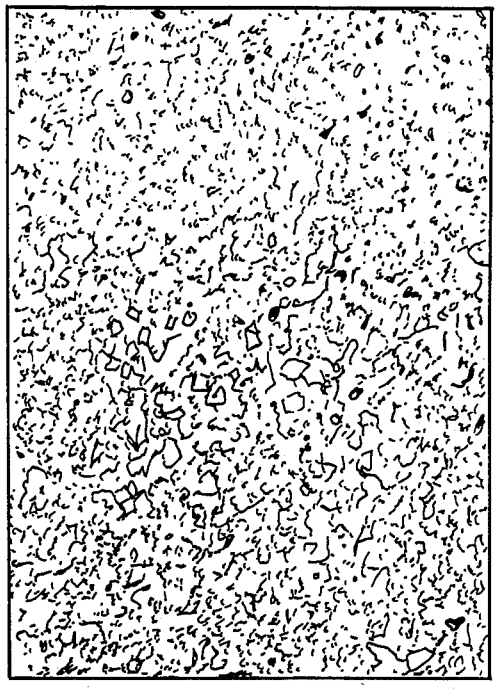

FIG. 7 is a micrograph of a transverse surface of the same bar after swaging, etched and at a magnification of 260×.

These micrographs indicate that the product produced has all of the characteristics of steel rods and bars rolled on conventional mills. In fact, the product is even superior in many respects, because there is an absence of non-metallic stringers of silicon and aluminum, and because the grain structure is more uniform than steel which has been produced from poured steel ingots. This will be a great advantage to heat treaters because the chemistry of the product is uniform and not subject to segregation as in poured steel ingots. Furthermore, the range of carbon, manganese, and other alloying ingredients will be uniform throughout the bar, thus making it easier to arrive at a given hardness. The bars of the present invention will also save a great deal of wasted material because there will be fewer failures do to the uneven chemistry ranges present in steel from poured ingots. Additionally, quality will be superior because there will not be seams which are found in rolled steel, and therefore, fewer defects in the finished product.

Figure 8:
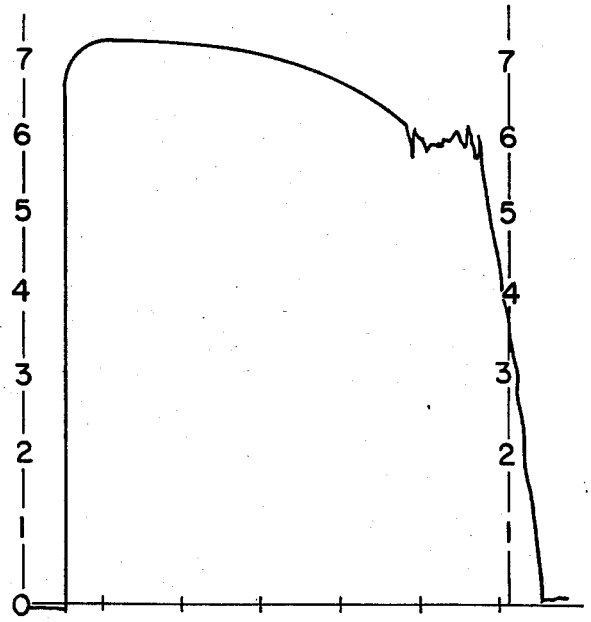
FIG. 8 is a graph showing the results of tensil, yield and elongation tests performed on a steel bar produced in accordance with this invention.

Referring now to FIG. 8, the results of tensile strength, yield strength, and total elongation tests are shown graphically. The sample with which the tests were performed was a one inch gauge length bar having a 3/16 inch diameter reduced section. The yield strength of the sample is 45,000 lbs/in$^2$; the tensile strength is 54,000 lbs/in$^2$; and the total elongation is 23%. These tests show that steel bars produced in accordance with this invention posess ductility equivalent to that found in rolled steel bars produced by conventional means.

The following examples illustrate the present invention and are not intended to limit the invention, but rather, are presented for purposes of illustration. The percentages are by weight unless otherwise specified.

EXAMPLE 1

Mill scale from steel mill operation is screened and placed in a ball mill to reduce the particle size to an average of 40 microns. Next the mill scale is passed to a reduction furnace where it is reduced in a hydrogen atmosphere for 30 minutes at a temperature of about 1200° F. (649° C.). After cooling, the reduced mill scale is passed to a mixer to which is added manganese and carbon each being about 40 microns in particle size in amounts to provide the required percentages to meet ASTM, AISI or API specifications. For example, A.I.S.I., C 1010 is produced containing 0.08 to 0.013 carbon, 0.30 to 0.60 manganese, with the remainder being reduced mill scale. The resultant particulate mass is thoroughly admixed and clear liquid paraffin is added.

The resultant admixture is removed from the mixer and pressed in a closed die to form a bar. The resulting bar is sintered at a temperature of about 1500° F. (815° C.) under a hydrogen atmosphere.

The resultant bar is then heated in a hydrogen atmosphere to about 2400° F. (1315° C.), cooled, reheated to 2100° F. (1148° C.) and passed to a swaging machine to form a rod. The rod is then drawn on a draw bench to produce a wire product having good tensile strength.

EXAMPLE 2

The procedure of Example 1 is repeated by substituting for mill scale $Fe_3O_4$ obtained from iron ore containing $Fe_2O_3$, silicon and other contaminants, by grinding the iron ore to an average particle size of abut 40 microns, admixing it with lime, firing in a rotary kiln at 1500° F. (815° C.), crushing and magnetically separating the resulting $Fe_3O_4$ particles. The resulting wire product has good tensile strength.

EXAMPLE 3

Mill scale, iron pellets or taconite pellets are crushed to −235 mesh. The iron powder is analyzed to determine silicon content, which is compensated by addition of calcium to form tri-calcium silicate crystals. The non-metallics such as sulfur, silica, calcium and phosphorus and any tramp gauge are treated and dissolved with a suitable acid. The iron and acid mixture is passed through a filter press which effectively separates the iron from the impurities leaving 99%+ pure iron powder. The powder is then washed, dried, and roasted at about 1500° F. (815° C.) in a rotary kiln or stationary continuous furnace where it is reduced. The iron powder is then recrushed. The reduced iron powder is magnetically separated, and mixed with carbon, manganese, other desired alloying components, and a binder which is preferably zinc stearate, thus forming a particulate admixture. The particulate admixture is then pressed into a bar under a pressure of about 20 tons per square inch (276. megapascals), or an amount of pressure sufficient to form a coherent mass having a density of at least about 0.2408 lbs./in$^3$ (6.67 g/cm$^3$). The bar is then sintered at 1700° F. (927° C.) for two hours and then heated to about 2300° F. (1260° C.). The resultant steel alloyed bar, while still hot, is swaged, rolled, or drawn to size to form the product bar. The product bar can then be cold-worked into the final product.

Although the invention has been described in considerable detail with particular reference to certain preferred embodiments thereof, variations and modifications can be effected within the spirit and scope of the invention as described hereinbefore, and as defined in the appended claims.

What is claimed is:

1. A process for producing a powder metallurgy article substantially free of non-metallic stringers, which process consists essentially of the steps (A) grinding mill scale into a finely divided particulate, (B) completely reducing the particulate mill scale to form substantially pure iron in a single step, (C) forming a particulate admixture consisting essentially of the substantially pure iron, manganese, and carbon, (D) admixing a binder with said particulate admixture to form a bonded particulate admixture, (E) compressing saidi bonded particulate admixture into a coherent mass having a density of from about 6.67 g/cm$^3$ to about 7.83 g/cm$^3$, (F) heating said coherent mass in a non-oxidizing atmosphere at elevated temperature to sinter said coherent mass, thereby forming a sintered mass having structural integrity, (G) heating said sintered mass in a non-oxidizing atmosphere to a temperature just below the fusion temperature of iron, thus forming an alloyed article, and (H) working said alloyed article at elevated temperature to decrease its grain size.

2. The process of claim 1 wherein said particulate admixture is formed using iron having an average particle diameter of between about 35 and about 45 microns.

3. The process of claim 1 wherein said iron has an average particle diameter of about 40 microns.

4. The process of claim 1 wherein said binder is zinc stearate.

5. The process of claim 1 wherein said heating step (G) is at a temperature below 2600° F.

6. The process of claim 1 wherein said heating step (G) is at a temperature of between about 2350° and 2395° F.

7. The process of claim 1 wherein said particulate admixture contains from about 0.035 to about 2.0 weight percent manganese, and from about 0.04 to about 2.00 weight percent carbon.

8. The process of claim 1 wherein said compact mass is sintered at a temperature in the range of from abut 1400° to about 1600° F.

9. The process of claim 1 wherein said particulate admixture contains at least one additional alloying ingredient.

10. The process of claim 9 wherein said at least one additional alloying ingredient is selected from the group consisting of chromium, nickel, molybdenum, lead, sulfur, aluminum and vanadium in a reduced state.

11. The process of claim 1 wherein Step (C) is conducted to compress said particulate admixture into a coherent mass having a density of from about 0.2550 lbs/in$^3$ (7.05 g/cm$^3$) to about 0.2833 lbs/in$^3$ (7.83 g/cm$^3$).

12. The process of claim 1 wherein Step (H) comprises swaging, rolling, or drawing said mass at elevated temperature to produce an end-product having a density of from about 0.2408 lbs/in$^3$ (6.67 g/cm$^3$) to about 0.2833 lbs/in$^3$ (7.83 g/cm$^3$).

13. The process of claim 12 wherein said end-product has a density of from about 0.2550 lbs/in$^3$ (7.05 g/cm$^3$) to about 0.2833 lbs/in$^3$ (7.83 g/cm$^3$).

14. The process of claim 13 wherein said end-product has a density of about 0.2833 lbs/in$^3$ (7.83 g/cm$^3$).

15. The process of claim 1 wherein Step (E) is carried out by compressing said admixture under pressures of from about 20 to about 40 tons per square inch.

16. The process of claim 1 wherein Step (E) is carried out by compressing said admixture under pressures of from about 30 to about 40 tons per square inch.

17. The process of claim 1, wherein the binder is hydrocarbonaceous.

* * * * *